US006409386B1

(12) United States Patent
Trani et al.

(10) Patent No.: US 6,409,386 B1
(45) Date of Patent: Jun. 25, 2002

(54) CONTAINER MADE OF FLEXIBLE MATERIAL, PARTICULARLY FOR LIQUIDS

(75) Inventors: Giorgio Trani; Marion Sterner, both of Venice (IT)

(73) Assignee: BP Europack S.p.A., Lugo di Vicenza (IT)

( * ) Notice: Subject to any disclaimer, the term of this patent is extended or adjusted under 35 U.S.C. 154(b) by 0 days.

(21) Appl. No.: 09/877,677

(22) Filed: Jun. 8, 2001

(51) Int. Cl.[7] ..... B65D 30/20

(52) U.S. Cl. ..... 383/120; 383/104; 383/906; 383/907; 426/85; D9/305

(58) Field of Search ..... 383/104, 120, 383/907, 906; 426/85; D9/305

(56) References Cited

U.S. PATENT DOCUMENTS

| | | | | | |
|---|---|---|---|---|---|
| 426,770 | A | * | 4/1890 | Claussen | 383/907 X |
| 426,841 | A | * | 4/1890 | Mortson | 383/907 X |
| 426,842 | A | * | 4/1890 | Mortson | 383/907 X |
| 4,795,271 | A | * | 1/1989 | Lane, Jr. et al. | 383/104 |
| 5,016,755 | A | * | 5/1991 | Kim | 383/907 X |
| D319,780 | S | * | 9/1991 | Laaki | D9/305 |
| 5,213,418 | A | * | 5/1993 | Dancy et al. | 383/907 X |
| D383,060 | S | * | 9/1997 | Pfuhl et al. | D9/305 |
| 5,758,473 | A | * | 6/1998 | Patelli | 383/906 X |

FOREIGN PATENT DOCUMENTS

| | | |
|---|---|---|
| EP | 0 620 156 | 10/1994 |
| FR | 1 464 641 | 3/1967 |

* cited by examiner

*Primary Examiner*—Jes F. Pascua

(57) ABSTRACT

A container for liquids or fluid products, including viscous ones, made by folding and heat-sealing a single sheet of flexible material. The single sheet is folded so as to form two mutually opposite quadrangular faces directly heat-sealed along two consecutive sides, while the third side of each one of the two faces is connected by an accordion-like portion which forms a substantially triangular base for the container and a fourth side has an additional accordion-like portion which forms a closure wall. The container has a filling opening on one of the two first sides or on the corner where they converge.

5 Claims, 4 Drawing Sheets

CONTAINER MADE OF FLEXIBLE MATERIAL, PARTICULARLY FOR LIQUIDS

CROSS-REFERENCE TO RELATED APPLICATIONS

The disclosure of Italian Application Serial No. PD2000A000012 filed Jan. 24, 2000 is incorporated herein by reference.

BACKGROUND OF THE INVENTION

The present invention relates to a container for liquids or for fluid products, including viscous ones, obtained by folding and heat-sealing a single sheet of flexible material.

A very wide variety of containers for fluids, obtained by folding a single sheet of flexible material, is commercially available.

Despite their widespread marketing, containers of the prior art are not free from drawbacks.

In particular, they are not self-supporting when they contain liquids or granular fluids.

These kinds of substances in fact do not have a shape of their own and accordingly adapt to the container holding them, which when made of flexible material is unable to retain a preset shape.

Furthermore, currently known containers can be manufactured at costs which are sometimes not competitive and at low speeds.

SUMMARY OF THE INVENTION

The aim of the present invention is to eliminate or substantially reduce the problems of the prior art containers for liquids or fluid products, including viscous ones, obtained by folding and heat-sealing a single sheet of flexible material.

Within this aim, an important object is to provide containers having such a shape to be self-supporting.

Another object is to provide containers which have low manufacture and sale costs.

Another object is to produce containers by using know equipment.

Another object is to provide containers which can be manufactured rapidly.

This aim and these and others objects which will become better apparent hereinafter are achieved by a container made of flexible material, particularly for liquids or fluids, characterized in that it is made of a single sheet of flexible material which is folded so as to form two mutually opposite quadrangular faces directly heat-sealed along two consecutive sides and connected along two further sides by accordion-like portions obtained by folding said sheet, a first accordion-like portion forming, on a third side, a substantially triangular base, a second accordion-like portion forming a closure wall on a fourth side, a closable opening for filling said container being provided.

BRIEF DESCRIPTION OF THE DRAWINGS

Further characteristics and advantages of the container according to the invention will become better apparent from the description of a preferred but not exclusive embodiment thereof, illustrated only by way of non-limitative example in the accompanying drawings, wherein.

DESCRIPTION OF THE PREFERRED EMBODIMENTS

Figure 1:
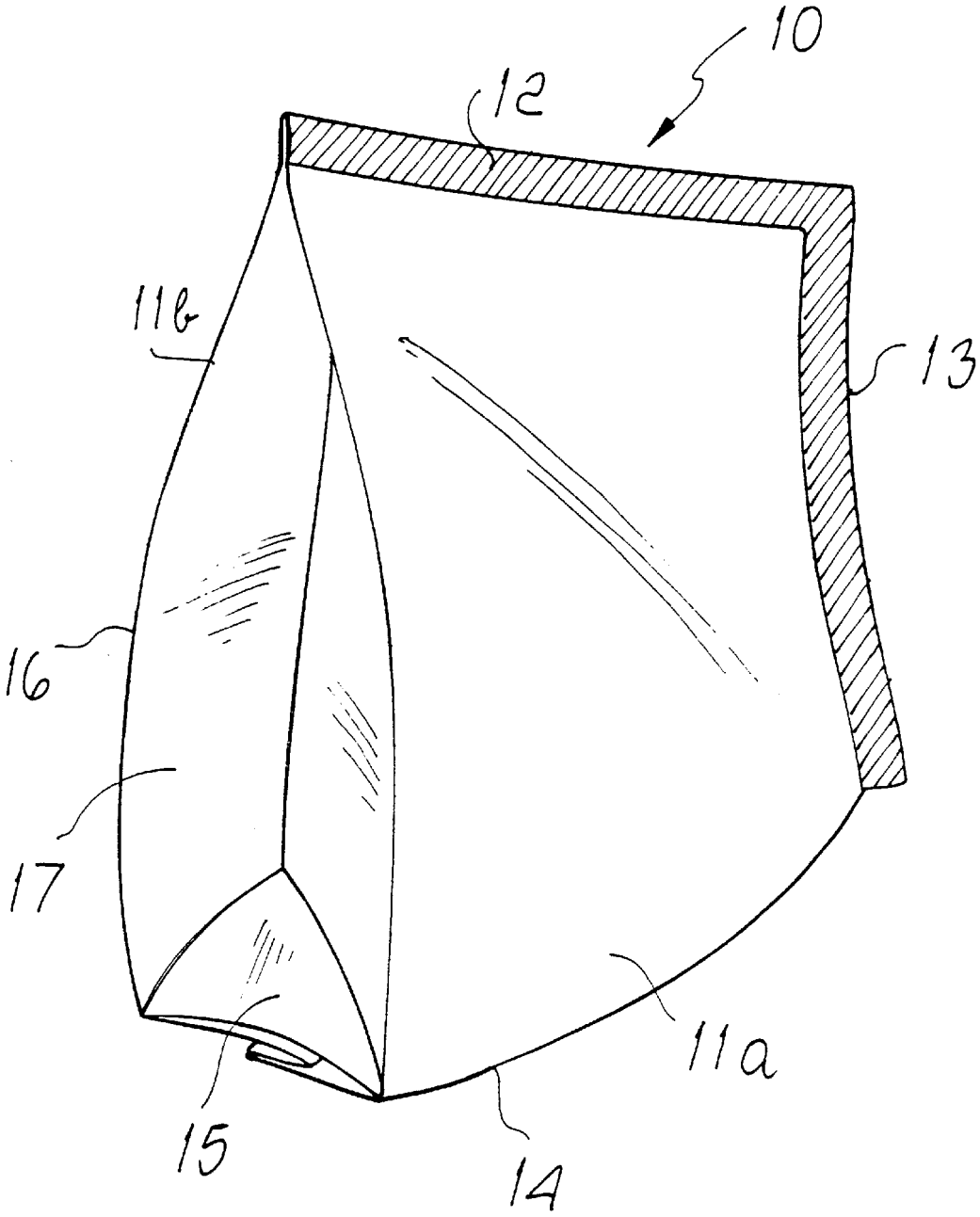
FIG. 1 is a perspective view of a container according to the invention.
Figure 2:
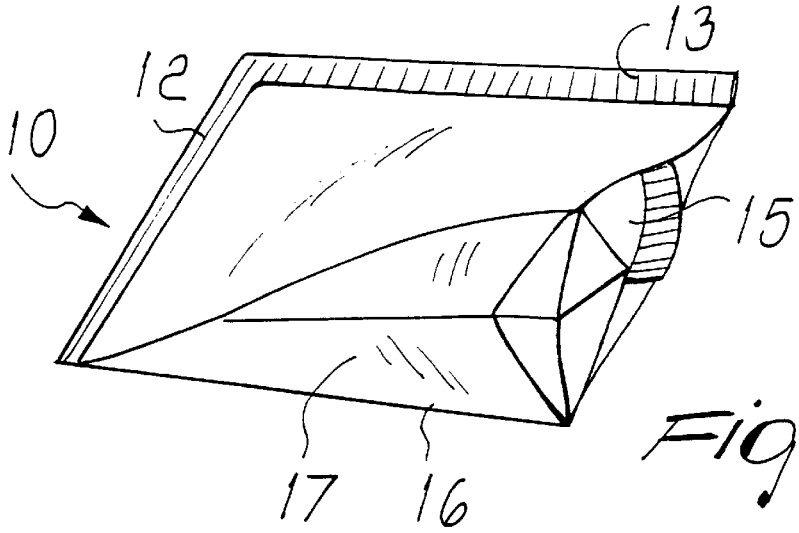
FIG. 2 is a further perspective view of the invention.
Figure 3:
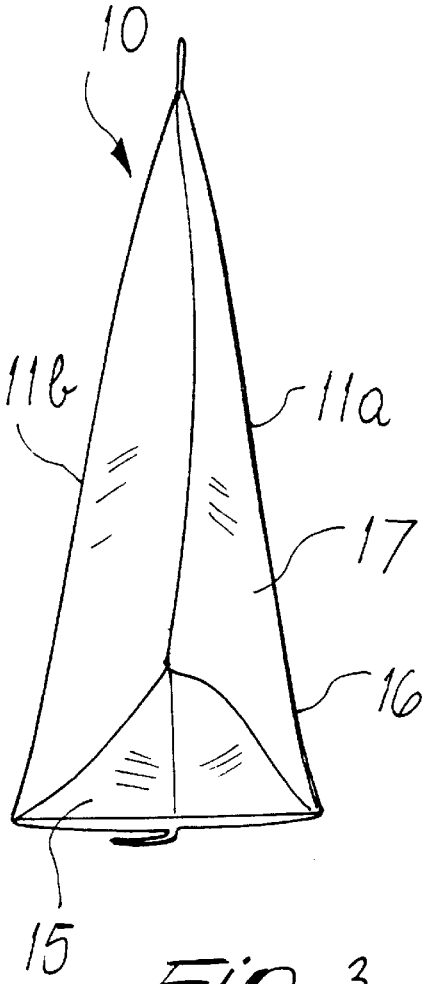
FIGS. 3 and 4 are the two side views of a container according to the invention.
Figure 4:
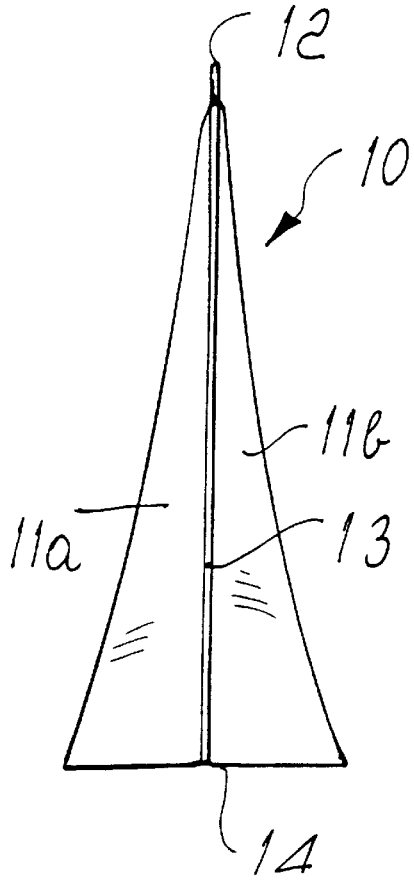
Figure 5:
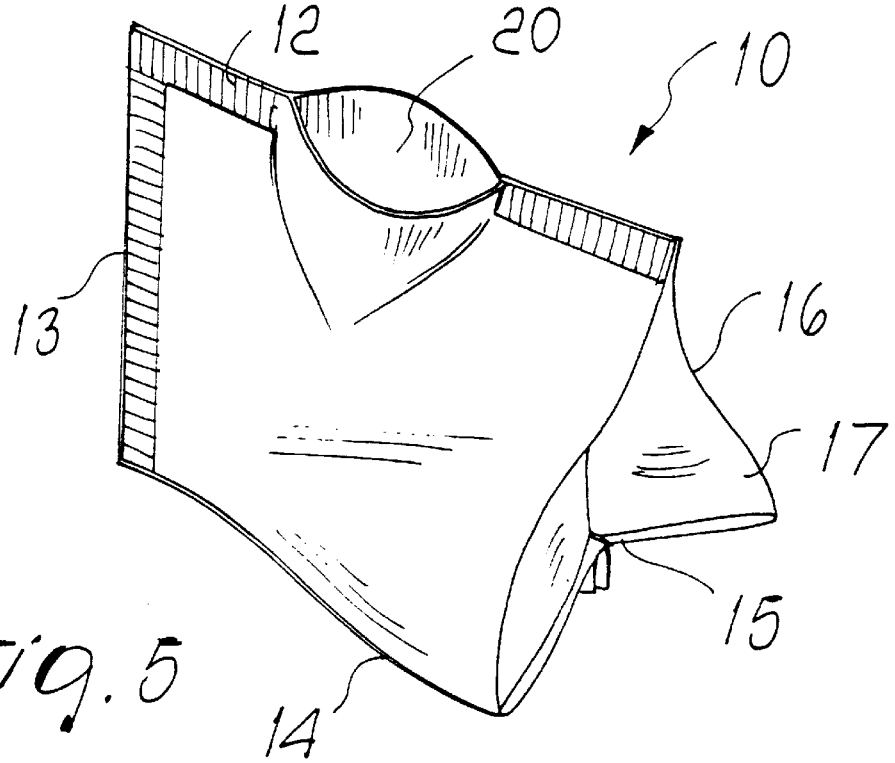
FIG. 5 is a perspective view of a container provided with an upper opening, according to a second embodiment of the invention.

With reference to the figures, a container for liquids or fluid products, including viscous ones, according to the invention, is generally designated by the reference numeral 10.

The container 10 is obtained by folding a single sheet so as to form two mutually opposite quadrangular faces 11*a* and 11*b*.

The two mutually opposite faces 11*a* and 11*b* are directly heat-sealed to each other along two consecutive sides 12 and 13.

A third side 14, consecutive to the side 13 and opposite to the side 12, connects the two faces 11*a* and 11*b* by means of a first accordion-like portion 15 which is produced by heat-sealing and subsequently folding the corresponding portions of the faces 11*a* and 11*b*.

The fourth side 16 constitutes a continuous closure wall of the container 10 and is also provided with a second accordion-like portion 17.

The third side 14 and the first accordion-like portion 15 form a substantially triangular base for the container 10, which in combination with the second accordion-like portion 17 allows said container to self-support when filled.

The container 10 has, on the side 12, a closable filling opening 20.

The opening 20 allows to fill the containers 10 directly during the production process if vertical machines are used.

The container 10 can also be filled after its manufacture again by means of the opening 20.

Figure 6:
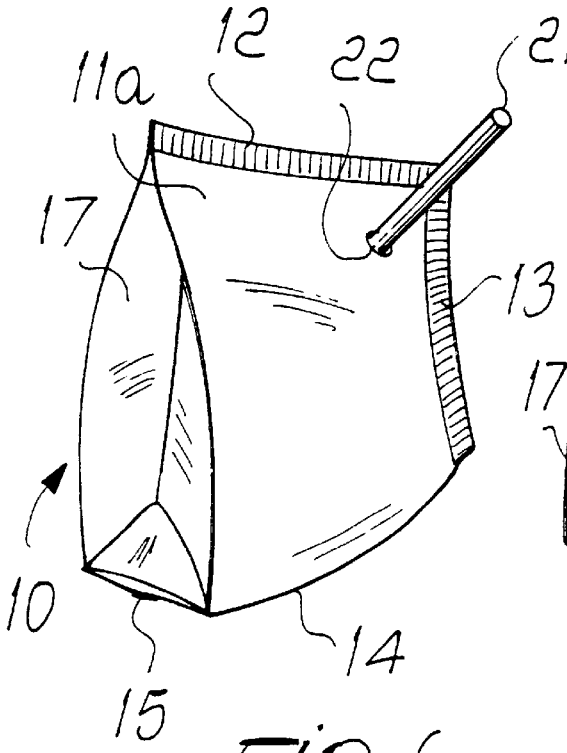
FIGS. 6 and 7 are perspective views of the container provided with a straw.
Figure 7:
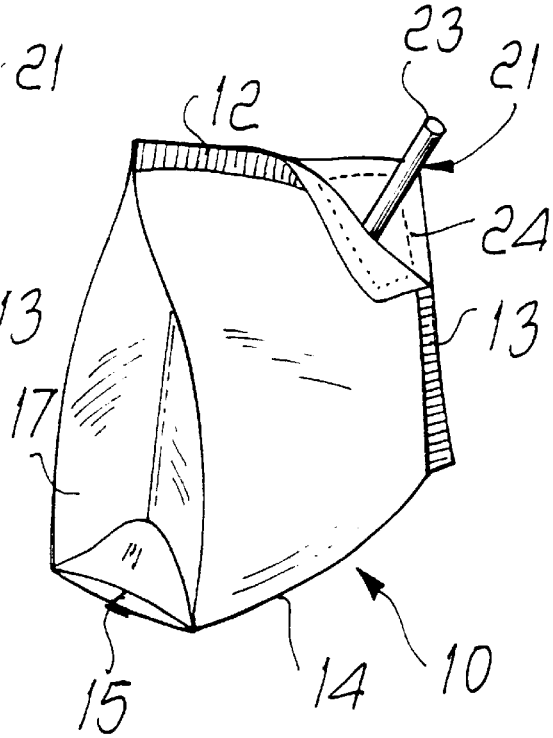

FIGS. 6 and 7 illustrate a container 10 provided with a straw 21.

The straw 21 can be inserted in the container 10 through a weakened portion 22 arranged in one of the two faces 11*a* and 11*b*.

Alternatively, the container 10 can be produced directly with a straw 21 arranged inside.

In the illustrated case, the straw 21 is arranged transversely, with one end 23 located at a peel-off heat-sealed portion 24 of the container 10.

Advantageously, in this case, the peel-off heat-sealed portion 24 is located in the corner where the directly heat-sealed consecutive sides 12 and 13 converge.

Figure 8:
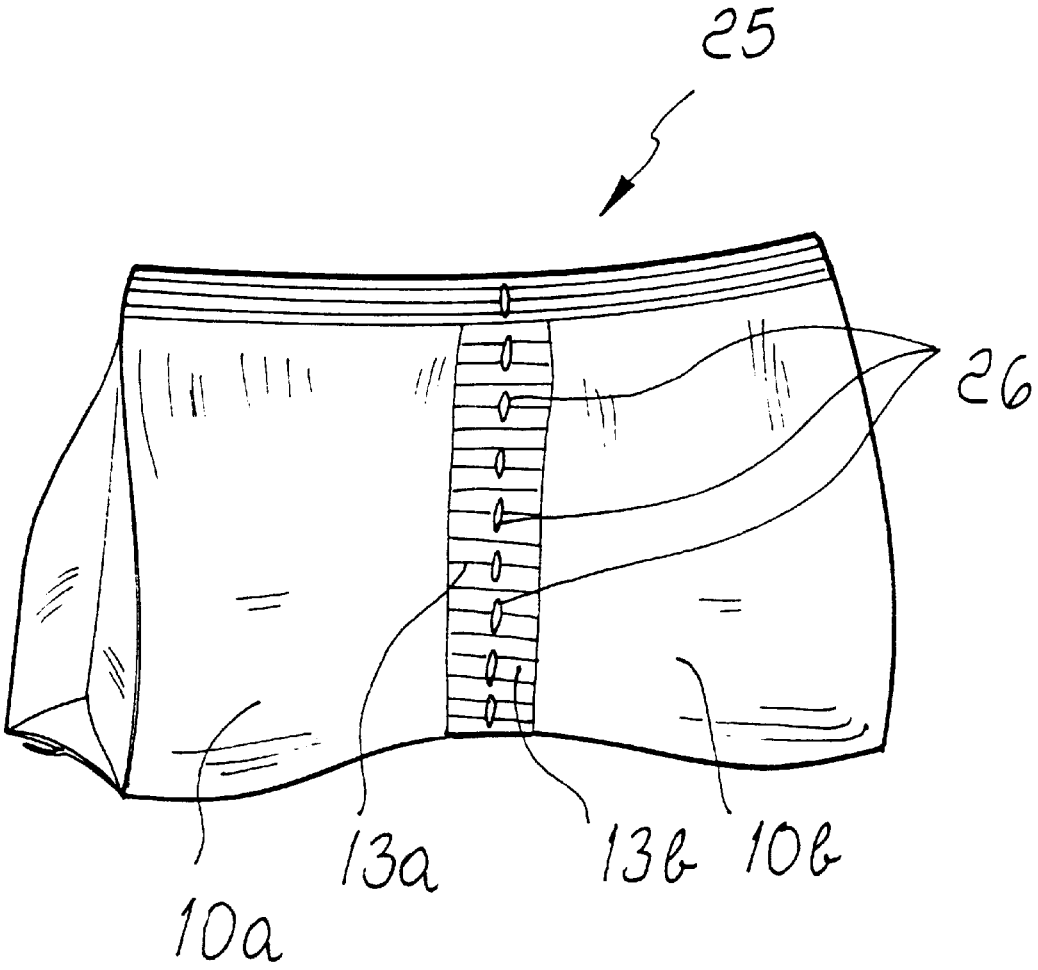
FIG. 8 is a perspective view of two containers according to the invention, joined along one of their sides.

Two identical containers 10*a* and 10*b* can form a double container, generally designated by the reference numeral 25, as shown in FIG. 8.

The two containers 10*a* and 10*b* are joined by means of their directly heat-sealed sides 13*a* and 13*b* which are consecutive to the bases 14*a* and 14*b*.

The two containers 10*a* and 10*b* can be separated by means of a series of prescores 26 formed longitudinally along the joined sides 13*a* and 13*b*.

In practice it has been found that the present invention has achieved the intended aim and objects.

In particular, it is evident that a container for liquids or fluid products, including viscous ones, has been provided which is capable of self-supporting when filled and of keeping a preset shape.

The container can also be manufactured at low costs and by using equipment of the known type or in any case equipment already used to manufacture containers having a different shape.

The present invention is susceptible of numerous modifications and variations, all of which are within the scope of the inventive concept.

All the details may be replaced with other technically equivalent elements.

In practice, the materials used, so long as they are compatible with the contingent use, as well as the dimensions, may be any according to requirements.

What is claimed is:

1. A container made of flexible material, particularly for liquids or fluids, being made of a single sheet of flexible material which is folded so as to form two mutually opposite quadrangular faces directly sealed along two consecutive sides and connected along the two further sides by accordion-like portions obtained by folding said sheet, a first accordion-like portion forming, on a third side, a substantially triangular base, a second accordion-like portion forming a closure wall on a fourth side, a closable opening for filling said container being provided.

2. The container according to claim 1, wherein said closable opening is provided at the directly sealed side that lies opposite the bottom.

3. The container according to claim 1, wherein said first accordion-like portion on the base folds within the dimensions of said container.

4. The container according to claim 1, being connected to an adjacent container, separated along at least one longitudinal prescore formed along the directly sealed side consecutive to the base.

5. The container according to claim 1, comprising a straw arranged internally with one end at an openable portion of the two directly sealed sides.

* * * * *